United States Patent [19]

Knödel et al.

[11] Patent Number: 4,948,089

[45] Date of Patent: Aug. 14, 1990

[54] CONCRETE MOLD WITH ARRANGEMENT FOR MOUNTING TUBULAR COMPONENTS

[75] Inventors: Rolf Knödel, Kelkheim; Frithjof Schimpff, Wiesbaden; Wolfgang Bergenthal, Neu-Isenburg/Zeppelinheim; Thomas Zander, Langen/Hessen, all of Fed. Rep. of Germany

[73] Assignee: Wayss & Freytag Aktiengesellschaft, Frankfurt am Main, Fed. Rep. of Germany

[21] Appl. No.: 192,282

[22] PCT Filed: Aug. 27, 1987

[86] PCT No.: PCT/EP87/00487

§ 371 Date: Jun. 27, 1988

§ 102(e) Date: Jun. 27, 1988

[87] PCT Pub. No.: WO88/02049

PCT Pub. Date: Mar. 24, 1988

[30] Foreign Application Priority Data

Aug. 27, 1986 [DE] Fed. Rep. of Germany ..... 3629030

[51] Int. Cl.[5] ..... B28B 23/00

[52] U.S. Cl. ..... 249/86; 52/701; 249/39; 249/91; 249/177; 249/219.1

[58] Field of Search ..... 249/39, 61, 86, 91, 249/142, 146, 147, 177, 219.1; 52/125.5, 699–701

[56] References Cited

U.S. PATENT DOCUMENTS

| | | | |
|---|---|---|---|
| 1,365,718 | 1/1921 | Ogden | 52/701 |
| 3,333,388 | 8/1967 | Sandin | 52/701 |
| 3,471,118 | 10/1969 | Bormann et al. | 249/86 |
| 3,685,783 | 8/1972 | Hilson | 249/86 |
| 3,764,066 | 10/1973 | Kowell | 249/86 |
| 3,982,363 | 9/1976 | Dorris | 52/699 |
| 4,179,067 | 12/1979 | Baier | 238/91 |
| 4,198,798 | 4/1980 | Haydock | 52/699 |
| 4,526,739 | 7/1985 | Migliacci et al. | 249/86 |

FOREIGN PATENT DOCUMENTS

| | | | |
|---|---|---|---|
| 1033546 | 6/1978 | Canada . | |
| 0180937 | 5/1986 | European Pat. Off. . | |
| 3027086 | 2/1982 | Fed. Rep. of Germany . | |
| 3039931 | 4/1982 | Fed. Rep. of Germany . | |
| 3403873 | 8/1985 | Fed. Rep. of Germany . | |
| 1565510 | 5/1969 | France . | |
| 2122129 | 1/1984 | United Kingdom | 249/86 |

OTHER PUBLICATIONS

No. 1,926,398 Arthur Fischer Tumlingen, Kunststroffdübel, Dec. 19, 1964.

*Primary Examiner*—James C. Housel
*Attorney, Agent, or Firm*—Herbert Dubno

[57] ABSTRACT

For the production of cross ties for switches, made of concrete in a prestressing fixture, a recoverable device for the emplacement of tubular components is built into the bottom of the concrete form for the tie, which comprises a pin and a nipple inserted detachably into its bottom. The nipple can be inserted into a corresponding bore of a base plate. The bore determines the position of a tube in the cross tie, has an upper and a lower stop with which it is anchored in the pin or the base plate, respectively, and can be firmly tensioned upon the base plate.

6 Claims, 9 Drawing Sheets

CONCRETE MOLD WITH ARRANGEMENT FOR MOUNTING TUBULAR COMPONENTS

CROSS REFERENCE TO RELATED APPLICATIONS

This application is a national phase application corresponding to PCT/EP 87/00487 filed 27 August 1987 and based upon German application P36 29 030.0 filed 27 August 1986 under the International Convention.

FIELD OF THE INVENTION

The invention relates to the emplacement of tubular components in finished concrete parts, particularly for the attachment of fastening screws for rails in switch cross ties of prestressed concrete. More particularly the invention relates to devices consisting of a pin, upon which a tubular component can be plugged, and a nipple provided in its bottom, with which the fixture can be inserted into a corresponding recess in a concrete form.

BACKGROUND OF THE INVENTION

In the case of railroad ties it is necessary that rail fastening screws, which determine positioning of the track lie exactly at prescribed positions. This applies particularly to ties for switches is which this position varies from tie to tie.

The position of the rail fastening screws in the cross tie is fixed by means of screw anchors into which the screws are turned, or by means of tubes through which the screws are turned, or by means of tubes through which the screws are passed. The positionally correct assembly of these components for the fastening screws for the rails which continually change position in the cross tie represent a considerable cost factor in the manufacture of cross ties, which one endeavors to keep as small as possible through simplification of the design of these components and their fastening and by shortening of the assembly time. In addition, in cross ties produced in prestressing fixtures, the fastening of the components on the concrete form must not impede the movement of the tie resulting from setting up and prestressing in the form during the manufacturing process.

From FR PS 15 65 510, FIG. 2, a holding fixture is known for a component displaceable from the inner side of the concrete form with a nipple reduced in cross section opposite the retaining pin. This holding fixture has the disadvantage that it is not anchored in the concrete form. In rough handling at assembly it can drop out. During forming it could remain attached to the part being produced, and would have to be removed by a time-consuming post-forming operation from the anchor hole after concreting. Furthermore, it may be subjected to large shear forces between the concrete form and the part being produced when that part changes length during the production process.

Furthermore, an assembly anchor for ties is known from DE 30 39 931 which is connected in one piece to a fastening means of about equal cross section, which can be inserted into a bore of corresponding size in the concrete form. In this fastening means connected to the anchor it is considered a disadvantage that it cannot be recovered. Due to its relatively large cross section the fastening means has such strength that, even when there is a desired breaking point, the intended break does not occur with assurance. At removal of the tie from the form, the anchor thus can remain attached to the bottom of the form, and is pulled out of the concrete.

OBJECT OF THE INVENTION

It is the object of the invention to provide a recoverable fastening means for inserts in such a way that the nipple fixing the fastening means on the concrete form is solidly anchorable in the corresponding recess of the concrete form, and shears off easily when shear forces arise during the hardening and prestressing of the finished part without transferring stresses to the finished part, and can be replaced after shearing off by a new nipple with little effort.

SUMMARY OF THE INVENTION

This object is achieved in that the pin and nipple are independent parts, separate from one another, detachably connected to one another by suitable connecting means, the nipple has an upper and a lower stop such that with the upper stop the nipple can be anchored in the pin and with the lower stop can be anchored in the base plate of the concrete form, and means are provided by which the nipple fixes the pin solidly and immovably on the base plate.

In the construction according to the invention, the component to be emplaced the small tube for the insertion of the rail fastening screw, is plugged onto the pin of an independent fastening means not connected therewith. This fastening means has a nipple inserted into the bottom of the pin with a cross section much reduced with respect to the pin, which shears off reliably due to sufficient shear load and does not impede a shifting of the cross tie in the concrete form. Cross ties which are arrayed in the central area of the prestress fixture do not experience any shift. In these cross ties, the fastening means is fully recoverable. Upon withdrawal of the cross tie, the pin of the fastening means slips out of the tube, and the fastening means remains in the concrete form. A new tube can be plugged in for the next production run.

If the nipple is sheared off, then it is merely necessary to insert or screw a new nipple into the bore of the hollow pin. The floor of a pin drilled out in cup shape can be elastic and shaped like a Belleville spring so that by pressing against the upper stop of the nipple, it presses the lower stop of the nipple firmly against the bottom side of the concrete form. The nipple can have a shaft portion with slightly smaller diameter than the diameter of the bore and a height which equals about the height of the base plate plus the thickness of the bottom of a pin drilled out in cup shape, and which forms a stop with appropriately greater diameter.

The nipple at its lower region can be provided in a vertical direction with slots of such width that the segments remaining between the slots are insertable into the bore in a collapsed state.

Within the top portion of the nipple, an annular spring can be provided which, by return spring action, returns the segments into their initial position after they have been passed through a bore, whereby the stop anchors the fixture against the back side of the base plate.

A clamp which cooperates with corresponding recesses in the top portion of the segments of the nipple can hold the segments together for assembly and after assembly of the fixture, the clamp can be expelled downwardly.

The nipple can consist of an elastically yielding material and can have an upper shaft portion of a significantly smaller diameter than that of the lower shaft portion of the nipple. The upper shaft portion of the nipple can be provided with an upper stop enlarged in diameter, for a Belleville spring, which anchors the nipple under spring action in a pin which is drilled out in cup shape. The nipple with its elastically yielding bottom portion is capable of being inserted from above through the bore of the base plate and the stop of the bottom portion can be capable of being pressed firmly onto the base plate through return spring pressure of the Belleville spring.

In place of the Belleville spring, a helical spring can be used.

According to another aspect of the invention, in the bottom of the pin drilled out in a cup shape, a central bore can be provided with the same inside diameter as the bore of the base plate. Into this bore, a nipple can be inserted which is provided with an upper stop and a bore as well as a lower stop with slots and a conical internal thread. Below the upper stop at least as long, a portion is provided as the bottom and the base plate measure in combined thickness. By means of a cone provided with an external thread, which can be screwed into the nipple from below by a turning tool insertable into a recess on its upper surface and accessible through the bore, the lower stop can be firmly pressed against the side of the bore.

The bottom of a pin drilled out in cup shape can have a central bore of the same internal diameter as the bore in the base plate and into the central bore a nipple with an upper stop and an elastically yielding lower stop can be inserted. A shaft portion between the stops is as long as the combined thickness of the bottom and base plate. The nipple has slots in its lower region, and an inside wall is drilled out with a diameter decreasing downwardly.

After the insertion of the holding means into the bore from above, a cone corresponding to a conical bore of the nipple can be pressed into the nipple to press the slotted portion of the nipple against the wall of the bore of the base plate, and thus anchor the holding means in the base plate.

In another aspect of the invention, the bottom of a pin drilled out in cup shape has a central bore provided with a thread. Into the latter bore, the upper stop of a nipple of elastically yielding material can be screwed.

This nipple is provided with a thread and a recess for the insertion of a turning tool. A shaft portion points downwardly and is, in this region, bored out cylindrically and is provided with slots and a lower stop. The nipple has a slightly smaller outside diameter than the bore of the base plate, can be pushed beyond the stop through the bore, and can be tightened against the base plate by turning the nipple by means of a turning tool inserted into a recess therein.

In yet another embodiment, the bottom of a pin drilled out in cup shape has a central bore provided with a thread with a diameter greater than the diameter of the bore in the base plate.

Into the central bore, the upper stop of a nipple of elastically resilient material can be screwed. The nipple is provided with a thread and a recess for the acceptance of a turning tool. The downwardly facing shaft portion drilled out cylindrically on the inside, has up to the lower stop a slightly increasing outside diameter and slots.

The shaft portion an be pressed through the bore of the base plate beyond the lower stop and thus receives a shape which interiorly decreases conically downwards. The cone formed integrally with the nipple can be detached form the inside of the concrete form by impact and can be pressed into the conically decreasing shaft portion, thus additionally wedging the shaft portion within the bore. The pin can be heavy-wall pipe whose internal diameter equals the internal diameter of the bore in the base plate of the concrete form.

The nipple can have a drilled-out shaft, smooth on the outside, whose outside diameter is slightly smaller than the clear inside diameter of the pin and whose central bore is provided with an internal thread, into which a screw whose head forms the upper stop can be screwed from above and the nipple can be pressed with its lower stop against the base plate by the tightening of the screw.

Between the upper rim of the pin and a washer underneath the head of the screw, an elastic ring of synthetic material is provided. The ring is deformable by a tightening of the screw and can be pressed against the interior wall of the tube, whereby the tube is centered upon the pin and held fast with internal pressure.

BRIEF DESCRIPTION OF THE DRAWING

The above and other objects, features and advantages of the present invention will become more readily apparent from the following description, reference being made to the accompanying drawing in which:

FIG. 8 with a Belleville spring and a helical spring respectively;

FIGS. 14 and 15 show an arrangement of yet a further embodiment in which FIG. 14 is a vertical section; and FIG. 15 is a vertical section through the nipple;

SPECIFIC DESCRIPTION

Figure 1:
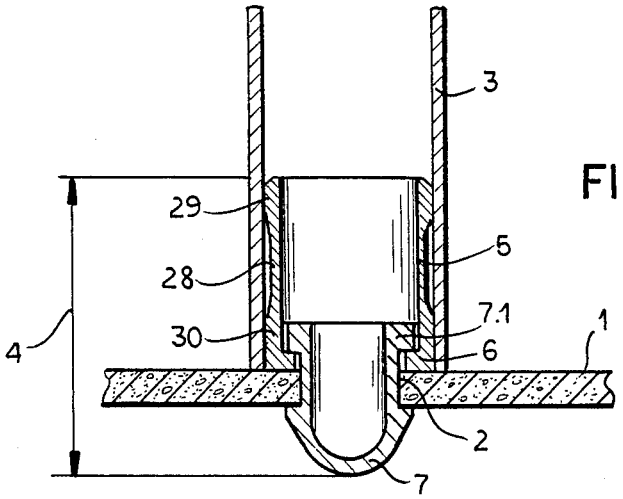
FIG. 1 is a vertical section through an arrangement according to the invention in the prestressing fixture.

In the base plate 1 of the concrete form of a prestress fixture there are bores 2 which exactly determine the position of the tubes 3 for the acceptance of the rail fastening screws in the cross tie. In the bore 2 the tube 3 is held by the means 4, 17, 50, 51, 52, 60, 73 fixed against transverse motion.

Figure 2:
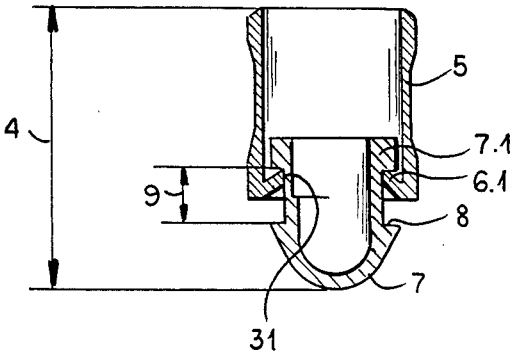
FIG. 2 is a vertical section through an arrangement with a saucer-shaped bottom of the pin, the left half showing a reduced nominal breaking section of the nipple.

A hollow pin (FIGS. 1 and 2) and a nipple 7 can be used. The nipple penetrates the bottom 6 of the pin in a central bore and is held in the bottom by means of an upper stop 7.1. The collar 8 anchors the nipple 7 outwardly in the concrete form 1. In this embodiment, the fixture 4 has a saucer-shaped bottom 6.1. The shaft 9 of nipple 7 is as high as the combined thickness of base plate 1 and the bottom 6 of the hollow pin 5.

Figure 3:
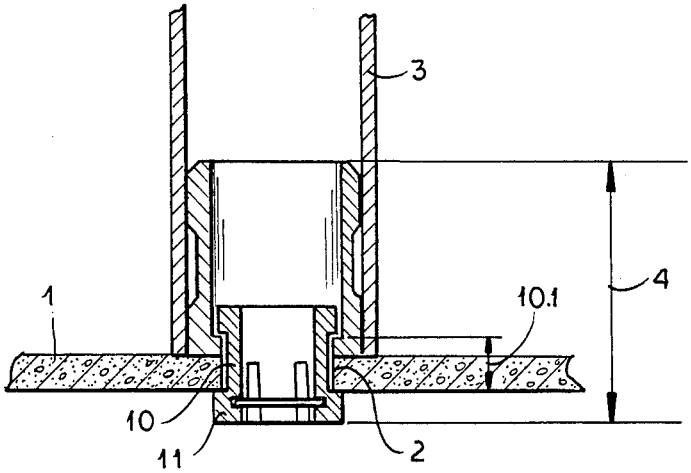
FIG. 3 is a vertical section through an arrangement according to the invention in assembled condition, i.e. with nipple not tensioned.
Figure 4:
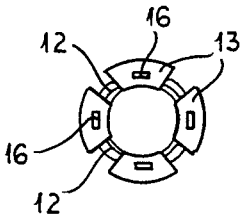
FIG. 4 is a top view on the relaxed nipple, in assembled condition.
Figure 5:
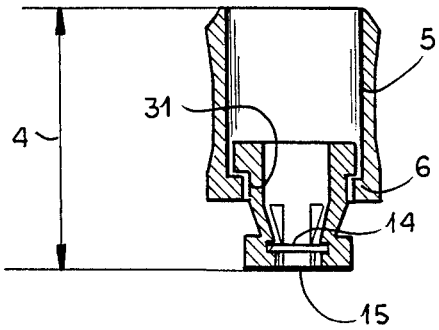
FIG. 5 is a vertical section before assembly with pretensioned nipple, the left half with reduced nominal break area.
Figure 6:
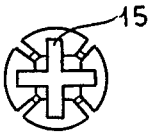
FIG. 6 is a top view of the nipple of FIG. 5.

In the fixture 4 of FIG. 3, nipple 10 is drilled through and in its lower extent so divided vertically by means of slots 12 into collapsible segments 13 that the segments with stop 11 can be slid through bore 2 in base plate 1 in collapsed condition (according to FIGS. 5 and 6). For assembly, the segments 13 of nipple 10 are collapsed and held in this condition by means of a clamp 13 which with its claws engages recesses 16, whereby at the same time annular spring 14 is tensioned.

When the fixture 4 is inserted into the bore, the clamp 15 is pushed out upwardly. The annular spring 14 relaxes and presses the segments 13 with collar segments 11 outwardly. The collar segments 11 anchor the fixture 4 securely in the plate.

Figure 7:
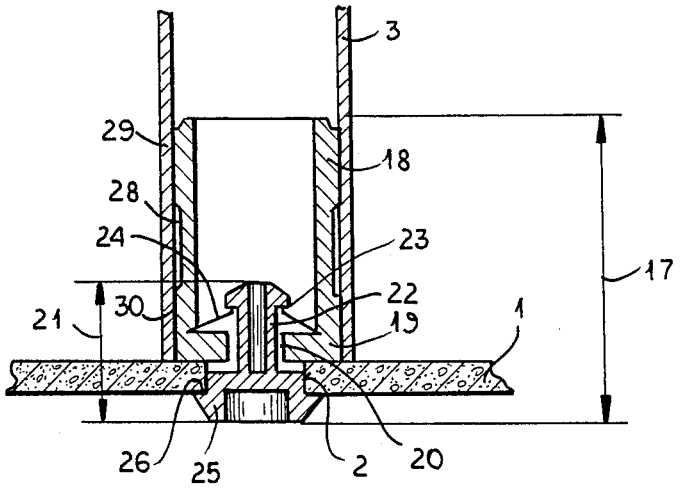
FIG. 7 is a vertical section in assembled condition of a fourth embodiment.
Figure 8:
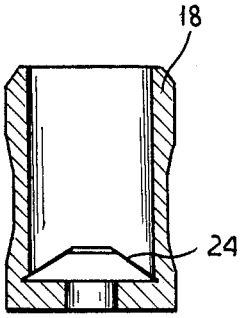
FIGS. 8 and 9 are vertical sections through the hollow pin thereof.
Figure 9:
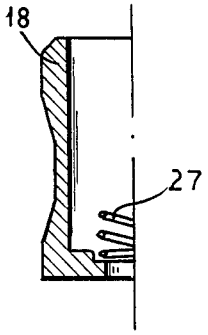
Figure 10:
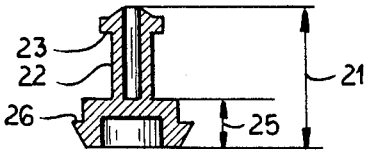
FIG. 10 is a vertical section through the nipple of this embodiment.

The fixture 17 (FIG. 7) has a loose nipple 21 held in the bottom 19 of the pin 18 vertically movable by springs (a Belleville spring 24 or a helical spring 27). The springs bear below against the base plate 19 of the hollow pin 18 and above against neck 23 of the upper shaft portion 22 of nipple 21.

The nipple 21 has a lower shaft portion 25 and an upper shaft portion 22 with a stop. By means of shaft or shank portion 22, the nipple 21 reaches through the bore 20 in the bottom 19 of pin 18 and through the springs 24, 27 is held by means of stop 23 by the spring in such manner that it can yield. For the assembly of fixture 17, the lower shaft portion 25 is pressed through the bore 2 of base plate 1, and by means of stop 26 it is firmly pressed against the base plate from below due to the spring force.

Figure 12:
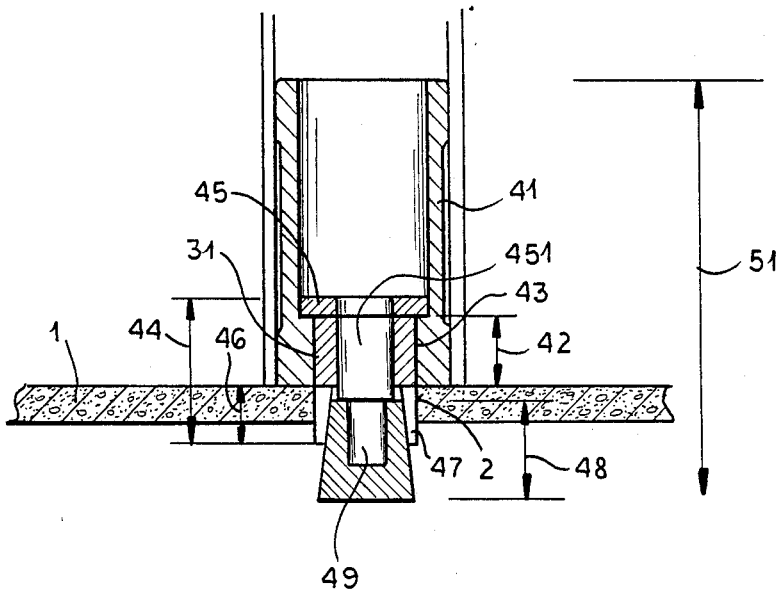
FIG. 12 is a vertical section through still another embodiment.

The fixture 51 (FIG. 12) has a pin 41 drilled out in cup shape and formed in its bottom 42 with a bore 43 of the same inside diameter as the bore 2 of the base plate 1. A nipple 44 is inserted into said bore 43 which is held in position by means of a stop 45 on the upper edge, the nipple 44 is provided with a bore 45.1 and in its lower portion 16 is provided with a conical female thread and slots 47.

A cone 48 provided with a male thread and a socket 46 for a spanner wrench can be screwed into the conical female thread in the lower portion 46 of nipple 44. For assembly purposes, the fixture 51 is preassembled by insertion of nipple 44 and a loose threading-in of cone 49, and is inserted into bore 2 of base plate. By means of a spanner wrench which is inserted from above through bore 45.1 into socket 49, the cone is tightened. The lower portion 46 provided with slots 47 is thereby spread against the bore 2 in base plate 1, and thus anchors the fixture 51 in the base plate in a manner analogous to a lower stop.

Figure 13:
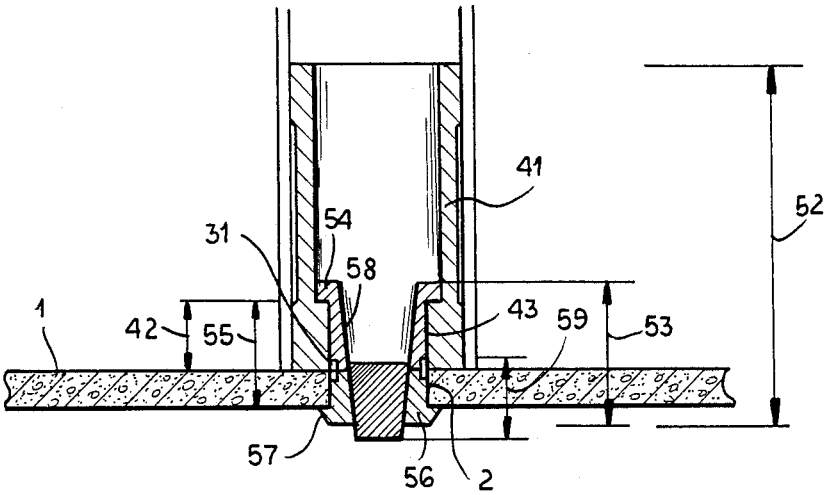
FIG. 13 is a vertical section through still a further embodiment.
Figure 15:
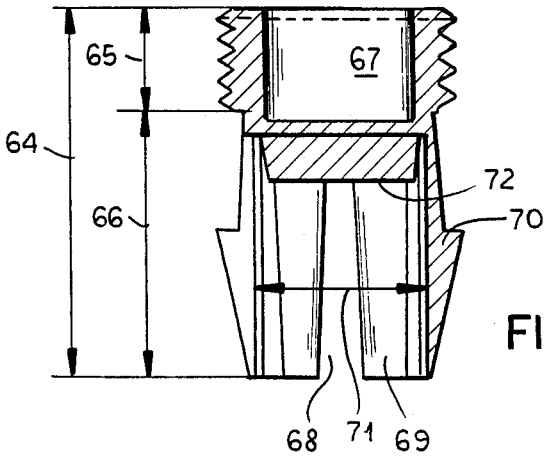

Fixture 52 (FIG. 13) represents a variation of the embodiment of fixture 51. A nipple 53 is pushed into the bore 43 of pin 41 which is fashioned as in fixture 51 with a conically bored inner surface 58 decreasing downwardly in diameter, up to the upper stop 54. Thereby nipple 53 provided in its lower portion 55 with slots 56 penetrates bore 2 of base plate 1 beyond the lower stop 57. By means of a cone 59 driven into nipple 53 from above which cone corresponds to the interior surface 58 of the nipple, the nipple is pressed with its lower area 55 against the surface of bore 2 in base plate 1, and fixture 52 is thus anchored.

Figure 11:
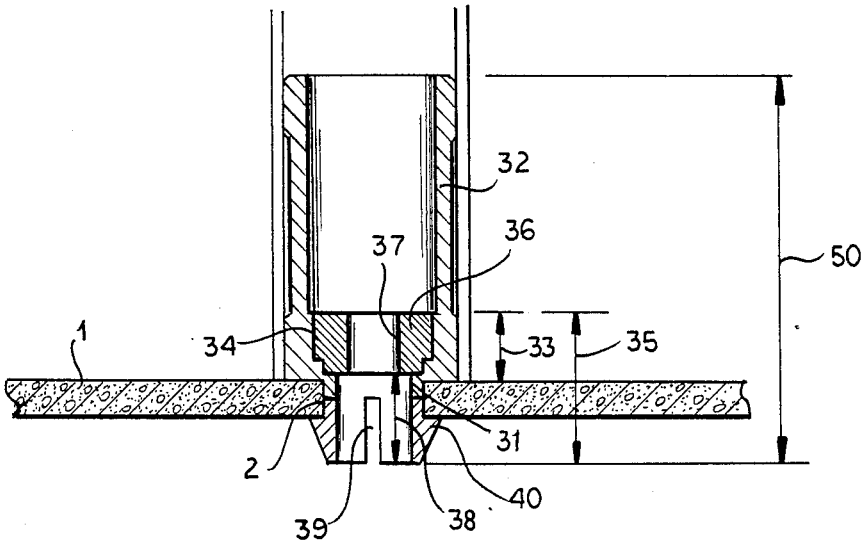
FIG. 11 is a vertical section through another embodiment of this invention.

The fixture 50 (FIG. 11) has its pin 32 bored out in cup shape and formed in its bottom 33 a bore 34 provided with a thread. Into this bore is screwed the upper stop 36 of nipple 35 which stop is provided with a male thread. In the upper area of stop 36 the nipple 35 is provided with a socket 37 for a spanner wrench. Its shaft portion 38 facing downwards is bored out cylindrically and fashioned on the lower edge with slots 39 and a lower stop 40.

For assembly, the preassembled fixture 50 with partly screwed-in nipple 35 is pushed downwardly in such manner that due to its conical conformation and the slots 39, the stop 40 on its lower shaft portion 38 collapses and lets itself be pushed through bore 2 of base plate 1. After passage through bore 2 the shaft portion 38 relaxes, so that the stop 40 comes into its nominal position. A spanner wrench is inserted into recess 37 from above and the stop 40 of nipple 35 is tightened against the bottom 33 of pin 32 until fixture 50 with stop 40 is securely clamped to base plate 1.

Figure 14:
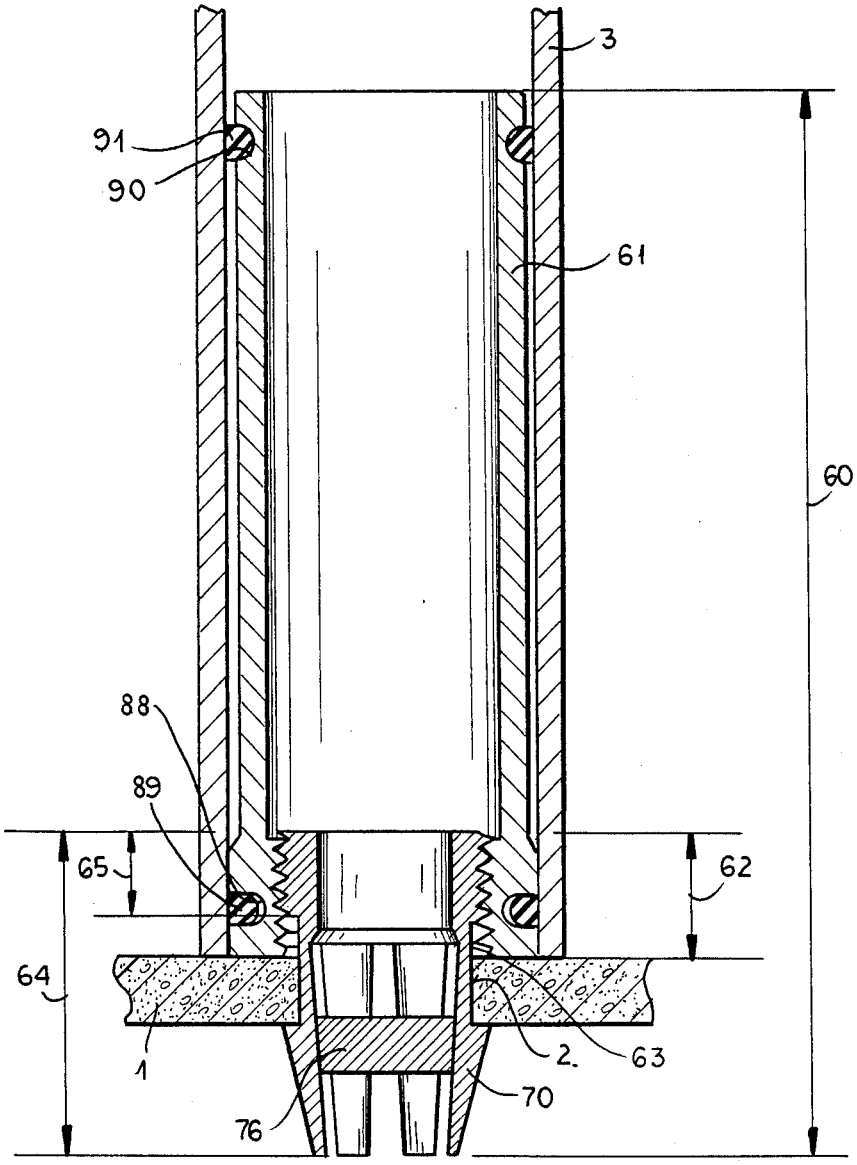

The fixture 60 of FIG. 14 has a pin 61 drilled out in cup shape with a bottom 62, which is provided with a bore 63 with internal thread. The upper stop of nipple 64 which is provided with an external thread is screwed into the internal thread of bore 63. So as to be able to assembly nipple 64 into pin 61 as desired from above or below or—after a possible shearing-off of shaft portion 66—to disassemble it or the upper stop 65, the outside diameter of bore 63 is smaller than the inside diameter of pin 61.

The nipple 64 has in the area of the upper stop 65, a recess for the insertion of a spanner wrench and is, in shaft portion 66, provided with an internal cylindrical bore 70 and slots 68. The outer wall of the shaft portion exhibits conicity up to the lower stop 70, with an outside diameter slightly increasing downwardly. After insertion of the nipple 61 into bore 2 of the base plate 1, the outer wall of the slotted shaft portion 66 lies against the cylindrical inside of bore 2. According to the conicity of the outer wall of the shaft, the wall of the inner bore 71 of shaft portion 66 is now imparted a slight conicity with downwardly decreasing inside diameter. Into this hollow cone is driven from above cone 72 formed in one piece, easily detachable, onto nipple 64 below stop 65 and above inner bore 71. It spreads the segments 69 of the slotted shaft portion 66 against the wall of bore 2 and wedges them inside the bore.

Furthermore, FIG. 14 shows the closure of the annular gap in the lower portion of pin 61 and tube 3 by means of elastically deformable plastic ring 89 inserted into the groove 88 of pin 61. The ring 91 is pressed under tension into groove 90 of pin 61 and bears against the interior wall of tube 3, and prevents it from rising by the effect of friction.

In the fixture 73 (FIG. 16) the pin 74 is a heavy-walled tube whose inside diameter 75 equals that of bore 2 in the base plate 1 of the concrete form. The nipple 76 with its cylindrical shaft 77 is slid from below through the bore 2 into the inner tube of pin 74. A screw 80 is threaded into a corresponding female thread 78 of nipple 76. A washer 82 and a disk 83 made of an elastic plastic is provided between head 81 of screw 82 acting as an upper stop of the nipple and pin 74. Upon tightening of screw 80 against the lower stop of nipple 76 the disk 83 is deformed outwardly, and pressed against the inner wall of tube 3. The tube is thereby centered, held against rising, and the tolerances on the inside diameter of tube 3 are taken up.

In the same operation, the pin 74 is pressed against base plate 1 due to the tightening of screw 80, and the fixture is thus emplaced in the concrete form.

Figure 16:
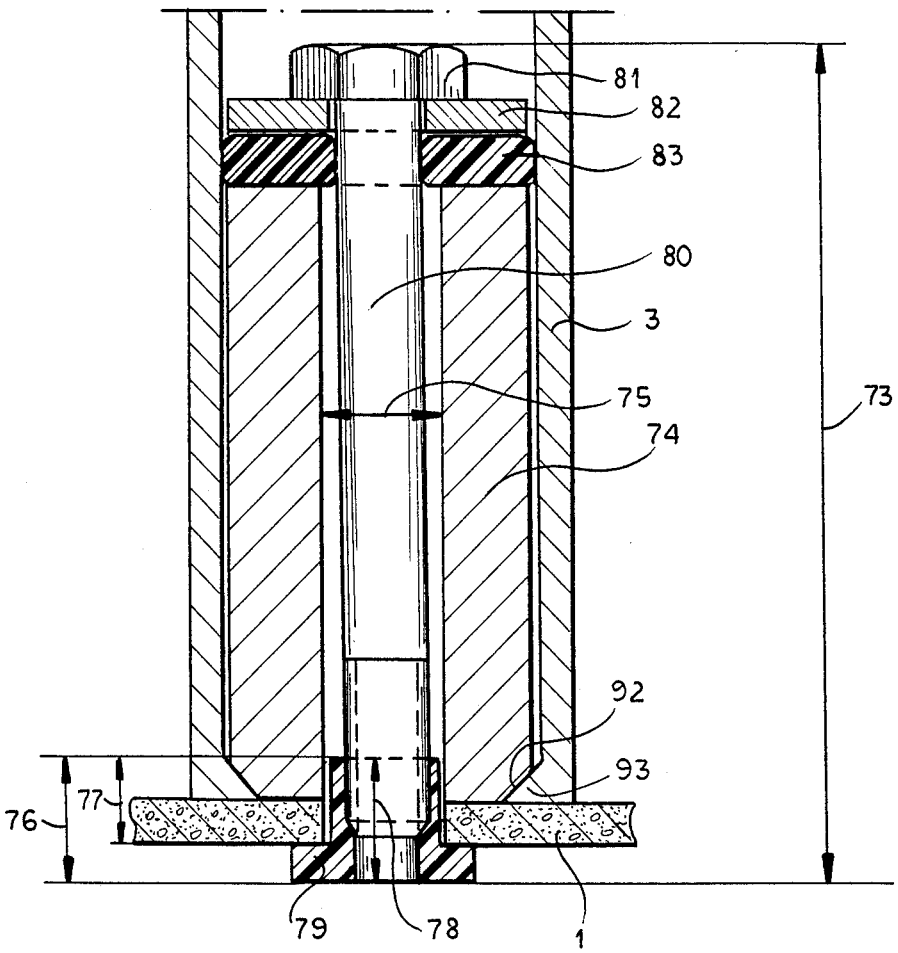
FIG. 16 is a vertical section through portions of an apparatus according to the invention.
Figure 17:
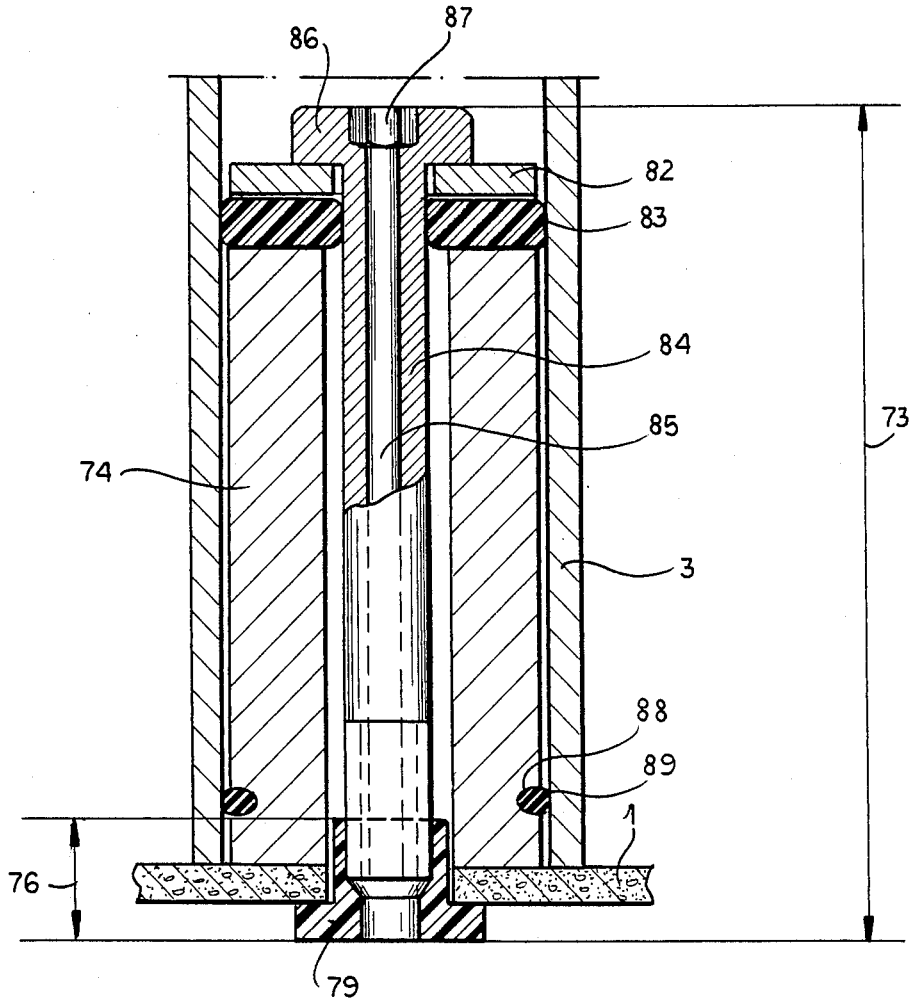
FIG. 17 is a vertical section through yet another arrangement.

FIG. 17 shows a variation of fixture 73 of FIG. 16. Here, the 84 is provided with a through-bore.

In case nipple 78 shears off during manufacture of the finished product, the screw connection between fixture 73 and the base plate 1 and the tensioning between plastic disc 83 and tube 3 comes undone simultaneously and automatically. The sheared-off holding fixture can, when the work piece is removed and it, the holding fixture, remains therein, be removed from the workpiece through bore 87 with suitable tools. The recess 87 in the head 86 of screw 84 makes possible a later tightening of the screw even after complete assembly of tube 1 and possible additional components through an opening with very small diameter.

In the place where the nipple meets the pin, FIGS. 1, 2, 3, 5 and 11 through 13 there is a reduction 31 of the wall thickness of the shaft of the nipple pertaining to all embodiments of the arrangement according to the invention. Thus a predetermined fracture place is denoted, which, when shear forces arise, prevents that larger constraining forces occur due to movement of the ties during the manufacturing process. Accordingly, the reduced pin 22 of nipple 21 represents the predetermined fracture place in fixture 17. The surface area 28 of the pin may deviate slightly from the cylindrical due to waviness of the generatrix. The radii of the generatrix with respect to the central axis each have a maximum 29 in the upper portion and 30 in the lower portion. There they are approximately of the same size as tube 3. Thereby the pin provides a secure seat for tube 3. Examples of execution are the pins 5, 18, 32, 41.

FIG. 16 shows a further possibility of construction of a means of sealing the annular space of pin 74 of a holding device 73 and tube 3. The pin 74 exhibits in its lower portion a chamfer 92, which mates with a corresponding lip 93 in the lower edge of tube 3.

We claim:

1. In An apparatus for making a switch tie from prestressed concrete, said apparatus comprising:

wall means defining a mold cavity and including at least one wall provided with bores;

a nipple received in at least one of said bores and anchored therein, said nipple having a pair of axially spaced stop collars separated by a shank narrower than said collars, one of said collars being braced against a first surface of said at least one wall opposite a second surface thereof bounding said cavity;

a hollow pin receiving said nipple and anchored thereby to said wall, said pin being detachable from said nipple and having an inwardly extending formation retained in place by the other of said stop collars; and resilient means between said other of said stop collars and said pin for urging said one of said collars against said first surface, said pin being received in a tubular element adapted to be embedded in the concrete so that said tubular element surrounds and hugs said pin and is retained thereby in said cavity.

2. The apparatus defined in claim 1 wherein said resilient means is a frustoconical part of said pin formed unitarily therewith as said formation and having a shape of a spring washer.

3. An apparatus for making a switch tie from prestressed concrete, said apparatus comprising:

wall means defining a mold cavity and including at least one wall provided with bores at predetermined locations and having a surface bounding said cavity;

a nipple received in at least one of said bores and anchored therein, said nipple being formed with a shank provided with at least one stop extending inwardly from said surface of said one wall and having a diameter larger than a diameter of said shank; and a hollow pin receiving said nipple and anchored thereby to said wall, said pin being detachable from said nipple and having an elastic cup shaped portion extending inwardly and formed with a bottom thereof contacting said surface of said one wall, said elastic portion being a spring washer shaped and being formed with means for connecting said pin with said one stop, said pin being adapted to be embedded in the concrete, and retained by said pin cavity.

4. An apparatus for making a switch tie from prestressed concrete, said apparatus comprising:

wall means defining a mold cavity and including at least one wall provided with bores at predetermined locations and having a first surface bounding said cavity;

a nipple received in at least one of said bores and anchored therein, said nipple being formed with a pair of axially spaced stop collars, one of said collars being elastically braced against a second surface of said one wall opposite said first surface;

a hollow pin receiving said nipple, said pin having a portion extending inwardly and formed with a bottom thereof contacting said first surface of said one wall, said pin being detachable from said nipple; and resilient means for contacting the stop opposite said one stop of said nipple with said portion of said pin, so that said one stop of the nipple is firmly pressed against a second surface of the one wall whereby a tubular element adapted to be embedded in the concrete surrounds and hugs said pins and is retained thereby in said cavity

5. The concrete mold as defined in claim 4 wherein said resilient means is a spring washer.

6. The concrete mold defined in claim 4 wherein said resilient means is a helical spring.

* * * * *